United States Patent [19]

Nakata

[11] Patent Number: 4,573,872

[45] Date of Patent: Mar. 4, 1986

[54] HIGH TEMPERATURE HEAT RESISTANT STRUCTURE

[75] Inventor: Yuji Nakata, Tokyo, Japan

[73] Assignee: Tokyo Shibaura Denki Kabushiki Kaisha, Kawasaki, Japan

[21] Appl. No.: 545,646

[22] Filed: Oct. 26, 1983

[30] Foreign Application Priority Data

Dec. 27, 1982 [JP] Japan ..... 57-232318

[51] Int. Cl.[4] ..... F01D 5/8; F28F 7/02

[52] U.S. Cl. ..... 416/96 A; 416/241 B; 416/241 R; 165/81; 428/608; 138/157

[58] Field of Search ..... 244/117 A, 123, 158 A; 60/730, 753, 267; 138/147, 149, 151, 157, 161, 120; 415/134, 138, 139, 200; 416/229 A, 231 R, 231 B, 241 R, 241 A, 241 B, 96 A, 97 R, 97 A, 96 R, 219 R, 219 A; 428/632, 633, 608; 165/81, 169, 170, 171

[56] References Cited

U.S. PATENT DOCUMENTS

| | | | |
|---|---|---|---|
| 2,157,456 | 5/1939 | Koyemann | 416/229 R |
| 2,750,147 | 6/1956 | Smith | 416/97 |
| 3,032,316 | 5/1962 | Kramer | 416/241 B |
| 3,300,180 | 1/1967 | Tuttle et al. | 415/139 |
| 3,357,850 | 12/1967 | Baker | 416/241 R |
| 3,378,228 | 4/1968 | Davies et al. | 416/229 A |
| 3,619,082 | 11/1971 | Meginnis | 416/96 R |
| 3,637,325 | 1/1972 | Morley | 416/241 A |
| 3,644,060 | 2/1972 | Bryan | 416/231 R |
| 3,758,233 | 9/1973 | Cross et al. | 416/229 A |
| 4,259,037 | 3/1981 | Anderson | 416/96 R |
| 4,370,789 | 2/1983 | Schilke et al. | 416/241 R |

FOREIGN PATENT DOCUMENTS

| | | | |
|---|---|---|---|
| 56-12001 | 2/1981 | Japan . | |
| 56-100298 | 8/1981 | Japan . | |
| 56-45035 | 10/1981 | Japan . | |
| 0535566 | 4/1941 | United Kingdom | 416/241 R |

*Primary Examiner*—Robert E. Garrett
*Assistant Examiner*—H. Edward Li
*Attorney, Agent, or Firm*—Schwartz, Jeffery, Schwaab, Mack, Blumenthal & Evans

[57] ABSTRACT

A heat resistance structure adapted to be used in a passage of a high temperature fluid, comprises a heat resistant metal plate having a smooth outer surface, a layer of a substance having a high heat transmission resistance extended along an internal surface of the metal plate, and heat conductive bodies provided in close contact with the layer, all being arranged in this order from the outer surface of the structure to the interior of the structure. A plurality of coolant passages are further provided through each of the heat conductive bodies.

5 Claims, 4 Drawing Figures

HIGH TEMPERATURE HEAT RESISTANT STRUCTURE

BACKGROUND OF THE INVENTION

This invention relates to a high temperature heat resistant structure which is adapted to be used in a high temperature environment or in a flow passage of a high temperature gas turbine for providing structural walls, stationary or movable blades and the like.

A heat resistant structure heretofore used for providing structural walls or blades of a gas turbine has been constructed by use of a heat resistant metal plate I of a thickness $t_m$, as shown in FIG. 1, one side surface $I_a$ of which is exposed to a high temperature fluid II of more than 1000° C., while the other side surface $I_b$ of which is exposed to a coolant III such as cooling water.

The heat resistant structure of the above described construction, however, suffers from following difficulties a and b when it is used in a gas turbine for providing above described members.

a. An extremely high thermal stress is created in the metal plate I, thus reducing the operational life of the gas turbine.

b. Local boiling-up of cooling water tends to occur, thus reducing the cooling effect and the operable period of the structure.

The thermal stress $\sigma$ of the heat resistant metal plate I is proportional to the heat flux q flowing through the metal plate I and expressed as follows.

$$\sigma = Ct_m q \tag{1}$$

wherein C is a constant determined by the material of the metal plate I. The heat flux q flowing through the metal plate I is on the other hand expressed as follows.

$$q = \alpha_g (T_g - T_{wout}) \tag{2}$$

wherein $T_g$ represents temperature of the high temperature fluid, $\alpha_g$ represents heat transfer coefficient on the high temperature side of the metal plate I, and $T_{wout}$ represents surface temperature on the high temperature side of the metal plate I.

As is apparent from equation (2), the heat flux q increases in accordance with $T_g$ when the surface temperature $T_{wout}$ is maintained at its highest allowable value, the increase of q inevitably increasing thermal stress $\sigma$. Although the thermal stress $\sigma$ can be restricted by reducing the thickness $t_m$ of the metal plate I as shown in equation (1), it is apparent that substantial reduction of the thickness $t_m$ is not practicable when the heat resistant structure is used under a high temperature and high pressure conditions.

In consideration of the local boiling-up of the cooling water, it is assumed that $T_{win}$ represents a surface temperature on the low-temperature side of the heat resistant metal plate I, and $T_{sat}$ represents a saturation temperature of the coolant III (cooling water in this case). A degree of superheat $\Delta T_{sat}$ is thus defined as follows.

$$\Delta T_{sat} = T_{win} - T_{sat} \tag{3}$$

It is apparent that the coolant III tends to be boiled-up when the degree of superheat $\Delta T_{sat}$ increases, and when the coolant boils-up, the advantage of providing a high heat conductivity $\alpha_C$ on the low-temperature side of the metal plate I is lost, and the cooling effect of the coolant III is substantially reduced.

To obviate the above described difficulty, the coolant III may be pressurized to increase the saturation temperature $T_{sat}$ and to reduce the degree of superheat $\Delta T_{sat}$. However, since the coolant III must be pressurized at approximately 100 Kg/cm$^2$ for achieving the above described object, a material of a high strength must be utilized for the construction of the coolant passage. As a consequence, the thickness of the heat resistant metal plate I must be increased, thus restricting the increase of the saturation temperature.

It is apparent that the boiling-up of the coolant may otherwise be prevented by reducing the surface temperature $T_{win}$ on the low-temperature side of the metal plate I. However, the surface temperature $T_{win}$ is expressed as $$T_{win} = T_g - \left( \frac{1}{\alpha_g} + \frac{t_m}{\lambda_m} \right) q \tag{4}$$

wherein $\lambda_m$ represents the heat conductivity of the metal plate I. Thus the reduction of the surface temperature $T_{win}$ inevitably increases the heat flux passing through the metal plate I so far as the temperature $T_g$ of the high-temperature fluid, the heat transfer coefficient $\alpha_g$, and the thickness $t_m$ of the metal plate I are considered to be constant.

As is apparent from equation (2), although the heat flux q may be increased by reducing the surface temperature $T_{wout}$ on the high-temperature side of the metal plate I, the increase of the heat flux q inevitably increases the thermal stress $\sigma$ as defined in equation (1), and reduces the operational life of the metal plate I.

Although there has been proposed an arrangement wherein ceramic plates bonded together are provided on the high-temperature side surface of the metal plate I, such an arrangement tends to produce irregularities on the bonded surface of the ceramic plates on the high temperature side of the metal plate I, thus impairing smooth flow of the fluid on the side of the metal plate.

SUMMARY OF THE INVENTION

An object of the present invention is to provide a heat resistant structure adapted to be used in a flow passage or else of a high-temperature gas turbine, the structure providing a smooth surface on the high temperature side thereof, while the thermal stresses produced in the structure are substantially eliminated.

Another object of the invention is to provide a heat resistant structure adapted to be used in a flow passage or other structures within a high-temperature gas turbine, wherein boiling-up of the coolant is substantially eliminated.

These and other objects of the invention can be achieved by a heat resistant structure comprising a heat resistant metal plate having a smooth outer surface exposed to the fluid, a layer of a substance having a high heat transmission resistance extended along an internal surface of the metal plate, heat conductive bodies provided in close contact with the layer, on a side thereof away from the metal plate, and a plurality of passages provided through each of the heat conductive bodies for coolant passing therethrough.

The layer of a substance having a high heat transmission resistance may be a sheet of ceramic fibers or a layer of a ceramic coating.

Otherwise, the heat resistant metal plate may be provided with a plurality of projections on an internal surface thereof, while each of the heat conductive bodies may be provided with a recess which is engageable with the projection, with the layer of the substance interposed between the projection and the recess.

DESCRIPTION OF THE PREFERRED EMBODIMENTS

Figure 1:
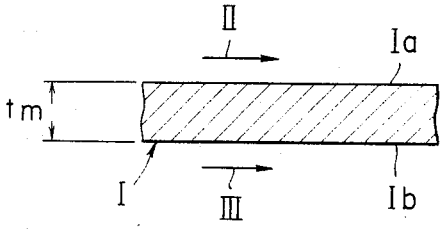
FIG. 1 PRIOR ART
FIG. 1 is a cross-sectional view showing one part of a conventional heat resistant structure.

Preferred embodiments of the present invention will now be described with reference to FIGS. 2–4 wherein similar members are designated by similar reference numerals.

Figure 2:
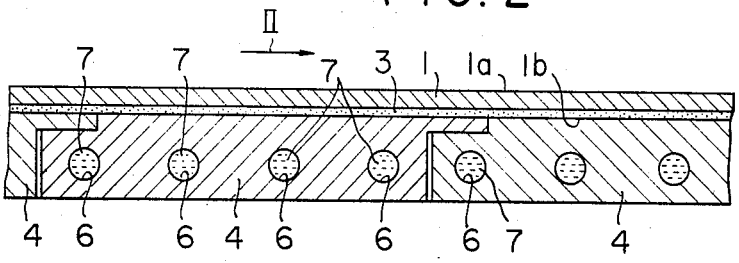
FIG. 2 is a cross-sectional view showing one part of a heat resistant structure according to the present invention.

In FIG. 2, there is illustrated a basic embodiment of the invention comprising a heat resistant metal plate 1 made of, for instance, a nickel-chromium alloy such as Inconel (Trade Name). The surface $1_a$ of the metal plate 1 is made smooth so as to assure a smooth flow of a high temperature fluid II. On an internal surface $1_b$ of the metal plate 1 is bonded a ceramic fiber sheet 3 exhibiting a high heat transmission resistance against the heat flow from the high temperature fluid II to the interior of the heat resistant structure through the metal plate 1. A plurality of heat conductive bodies 4 made of a heat conductive material such as copper and not constituting strength members are arranged along the internal surface of the metal plate 1. Since the heat conductive bodies 4 are arranged spaced away from neighboring bodies and thus to be slidable with respect to those neighboring bodies and along the internal surface of the ceramic fiber sheet 3, there is no possibility of creating thermal stresses in the heat conductive bodies 4. ("Spaced" is used here and in the claims to connote not that the bodies do not touch at all but that at least some of the laterally opposed surfaces of neighboring bodies are separated from one another.) A plurality of coolant passages 6 are provided through each of the heat conductive bodies 4 for circulating a coolant 7 such as cooling water through the coolant passages 6.

The advantageous features of the heat resistant structure shown in FIG. 2 will now be described theoretically.

It is assumed that $\lambda_c$ and $t_c$ represent the heat conductivity and the thickness of the ceramic fiber sheet, respectively, while $\lambda_m$ and $t_m$ represent the heat conductivity and the thickness of the heat resistant metal plate 1 as described with respect to the conventional construction shown in FIG. 1. Then, the surface temperature $T_{win}'$ on the low-temperature side of the ceramic fiber sheet 3 is expressed as follows.

$$T'_{win} = T_g - \left( \frac{1}{\alpha_g} + \frac{t_m}{\lambda_m} + \frac{t_c}{\lambda_c} \right) q \tag{5}$$

Since the heat flux q is given by equation (2), it is apparent from this equation that the surface temperature $T_{win}'$ can be reduced to a value lower than the temperature $T_{win}'$ in the equation (4) by selecting a low heat transfer coefficient $\lambda_c$ and a large thickness $t_c$ of the ceramic fiber sheet 3 regardless of the case where the thermal stress $\sigma$ is reduced by reducing the thickness $t_m$ of the metal plate 1.

On the other hand, the heat conductive bodies 4 made of, for instance, copper and cooled by the coolant 7, are placed closely adjacent to the low-temperature side of the ceramic fiber sheet 3, and hence the temperature $T_{win}''$ of the heat conductive bodies 4 on the surface thereof contacting with the ceramic fiber sheet 3 is made substantially equal to, or slightly lower than the temperature $T_{win}'$ defined by equation (5).

Thus, the degree of superheat $\Delta T'_{sat}$ of the surface of the heat conductive bodies 4 is defined as $$\Delta T_{sat}' = T_{win}'' - T_{sat} < T_{win}' - T_{sat} \tag{6}$$

and hence can be reduced to an extremely small value by reducing the surface temperature $T_{win}'$ of the ceramic fiber sheet 3. The reduction of the degree of superheat $\Delta T_{sat}'$ substantially eliminates the possibility of boiling-up of the coolant 7.

Furthermore, since the heat conductive bodies 4 are not rigidly coupled with each other, but instead are spaced away from neighboring bodies and slidable with respect thereto, the difference between the thermal expansions of the heat resistant metal plate 1 and the heat conductive bodies 4 can be absorbed by the slidable engagement of the heat conductive bodies, and the creation of thermal stresses can be thereby prevented. For this reason, even in a case where the difference between the temperature $T_g$ of the high temperature fluid II and the saturation temperature $T_c$ of the coolant is extremely large, most part of the temperature difference is supported by the ceramic fiber sheet 3 also not constituting a strength member, and thermal stresses in the heat resistant structure of this invention can be substantially eliminated. Furthermore, the boiling-up phenomenon of the coolant 7 can be eliminated regardless of the application of substantially no pressure to the coolant.

Figure 3:
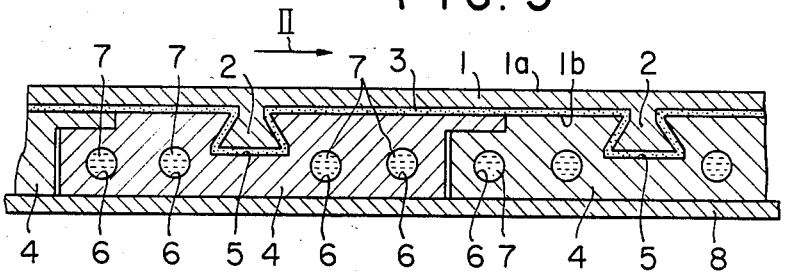
FIG. 3 is a cross-sectional view showing a preferred modification of the heat resistant structure shown in FIG. 2.

FIG. 3 illustrates another embodiment of the present invention wherein a plurality of projections 2, each having a dovetail shaped cross-section, are provided along the inside surface $1_b$ of the metal plate 1 with a predetermined interval maintained therebetween. The ceramic fiber sheet 3 is extended along and bonded to the inside surface $1_b$ of the metal plate 1 so as to envelope the dovetail shaped projections 2. Furthermore, each of the heat conductive bodies 4 is provided with a recess 5 of a cross-sectional configuration capable of receiving the dovetail shaped projection 2 covered by the ceramic fiber sheet 3, so that the heat conductive bodies 4 are maintained at their positions with the ceramic fiber sheet 3 interposed between the metal plate 1 and the heat conductive bodies 4. The heat conductive bodies thus maintained at their positions are coupled with each only other in a slidable manner (i.e., there are gaps between neighboring bodies) for absorbing and eliminating the thermal stresses tending to be created in the heat conductive bodies 4. A plurality of coolant passages 6 are provided through each of the heat conductive bodies 4 as in the previous embodiment for passing a coolant 7 therethrough. A reinforcing plate 8 is further provided on the side of the heat conductive bodies away from the ceramic fiber sheet 3 for converting the heat conductive bodies 4 on the side and reinforcing the structure on this side.

It is apparent that the above described embodiment of FIG. 3 is also advantageous in that it has a smooth outer surface over which the high temperature fluid II may flow without any disturbance, thermal stresses tending to be created in the structure can be substantially eliminated, and the boiling-up phenomenon of the coolant can be avoided.

Figure 4:
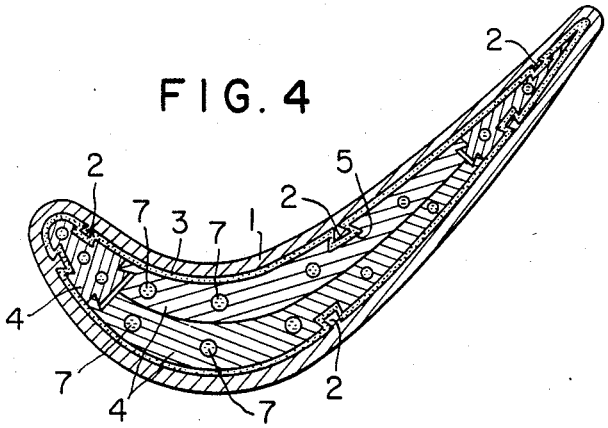
FIG. 4 is a cross-sectional view showing one example utilizing the heat resistant structure according to the invention.

FIG. 4 illustrates one preferred example utilizing the heat resistant structure such as shown in FIG. 2 or 3, wherein the heat resistant structure is applied to a turbine blade of a gas turbine. The construction of this example is substantially similar to that of the embodiment shown in FIG. 3, except that the heat resistant metal plate 1 is extended to envelope the entire construction of the turbine blade, and the reinforcing plate 8 of FIG. 3 is omitted.

Since the construction of the turbine blade shown in FIG. 4 is substantially similar to that of the embodiment shown in FIG. 3, it is apparent that the turbine blade of FIG. 4 has advantageous features substantially the same as those of the embodiment shown in FIG. 3.

Although in the embodiments shown in FIGS. 3 and 4, a plurality of projections 2 and mating recesses 5 of a dovetail shaped cross-section have been provided along the inside surface $1_b$ of the metal plate 1 and the opposing surfaces of the heat conductive bodies 4, the configuration of the projections 2 and the recesses 5 need not necessarily be of the dovetail shape, and any other suitable configuration may otherwise be utilized.

Furthermore, the ceramic fiber sheet 3 provided in the embodiments shown in FIGS. 2, 3 and 4 may be replaced by a layer of ceramic coating.

I claim:

1. A heat resistant structure adapted to be used in a passage through which flows a high temperature fluid, comprising:

a heat resistant metal plate having a smooth outer surface exposed to the fluid;

a layer of ceramic fiber material having a high heat transmission resistance extended along an internal surface of said metal plate;

a plurality of heat conductive bodies each spaced apart from adjacent bodies and each located in close contact with said ceramic fiber layer on a side thereof away from said metal plate, each of said heat conductive bodies being provided with a portion which is in slidable contact with a corresponding portion of the adjacent bodies; and a plurality of passages provided through each of said heat conductive bodies for passing a coolant therethrough, said heat resistant metal plate being provided with a plurality of projections on said internal surface thereof and each of said plurality of heat conductive bodies being provided with a recess engageable with respective ones of said plurality of projections with said ceramic fiber layer being interposed between each projection and respective recess.

2. A heat resistant structure as set forth in claim 1 wherein said heat conductive bodies are made of copper.

3. A heat resistant structure as set forth in claim 1 wherein said projections and recesses are formed to provide dovetail-shaped cross-sections engageable with each other.

4. A heat resistant structure as set forth in claim 3 wherein a reinforcing plate is further provided on the side of said heat conductive bodies away from the layer of the substance having a high heat transmission resistance.

5. A turbine blade made of a heat resistant structure as set forth in claim 1.

* * * * *